United States Patent [19]

Schleich et al.

[11] Patent Number: 4,616,464

[45] Date of Patent: Oct. 14, 1986

[54] COMPOSITE FIRE-RESISTANT CONCRETE/STEEL COLUMN OR POST

[75] Inventors: Jean-Baptiste Schleich, Kockelscheuer; Erwin Lahoda, Dahlem; Jean-Paul Lickes, Kayl, all of Luxembourg

[73] Assignee: Arbed S.A., Luxembourg, Luxembourg

[21] Appl. No.: 639,375

[22] Filed: Aug. 9, 1984

[30] Foreign Application Priority Data

Aug. 12, 1983 [LU] Luxembourg ..... 84966

[51] Int. Cl.[4] ..... E04C 3/34

[52] U.S. Cl. ..... 52/723; 52/729; 52/334; 52/260

[58] Field of Search ..... 52/722, 723, 724, 725, 52/727, 729, 730, 733, 334, 260

[56] References Cited

U.S. PATENT DOCUMENTS

| | | | |
|---|---|---|---|
| 1,496,819 | 6/1924 | Mitchell | 52/725 X |
| 2,115,504 | 4/1938 | Wallis | 52/726 |
| 2,375,116 | 5/1945 | Larkin | 52/729 |
| 2,441,890 | 5/1948 | Larkin | 52/729 |
| 2,664,740 | 1/1954 | Cochrane | 52/722 X |
| 2,987,855 | 6/1961 | Singleton et al. | 52/733 |
| 4,196,558 | 4/1980 | Jungbluth | 52/723 |

FOREIGN PATENT DOCUMENTS

| | | | |
|---|---|---|---|
| 15131 | of 1887 | United Kingdom | 52/724 |

*Primary Examiner*—John M. Jillions

*Attorney, Agent, or Firm*—Karl F. Ross; Herbert Dubno

[57] ABSTRACT

A composite structural element comprises a steel structural shape whose web is provided with one or more steel plates secured thereto by welding or bolting and embedded in the concrete filling the channels between its flanges. The concrete may also include a reinforcement secured to the plate. With a relatively simple structure the system has increased load-carrying capacity even under fire conditions.

19 Claims, 6 Drawing Figures

COMPOSITE FIRE-RESISTANT CONCRETE/STEEL COLUMN OR POST

FIELD OF THE INVENTION

Our present invention relates to a composite profile and especially to a post, column or like structural element comprising a steel structural shape containing concrete in a channel thereof and forming a fire-resistant structural element.

BACKGROUND OF THE INVENTION

The term "profile" as used herein and as used throughout most part of the world, refers to a metal structural shape, i.e. a steel-beam girder or like structural members having at least a pair of spaced apart flanges bridged by a web.

The term "composite profile" is intended to refer to such a structural shape, the open chamber or channel of which, between the flanges, is filled or at least partly filled with another material, generally concrete, the concrete body being secured to the profile to form a composite structural element.

Structural elements of this type may be fabricated so that the outer surfaces of the flanges remain anchored by the concrete. Structural elements of this type have been used successfully as posts, columns and like supporting elements in structures such as dwellings, factories, exposition halls, stadia, warehouses and like structures where fire resistance is an important factor.

In the past such structural elements have been designed based upon the calculation of the static load at room temperature to establish the steel cross section for the profiles contained within the elements and these profiles were then filled with concrete and coated with concrete. The fabrication of such fire-resistant composite structures was expensive and not always satisfactory, since for many purposes it was desirable that the flanges be exposed at least along their outer surfaces for attachment or other purposes.

Thus in U.S. Pat. No. 4,196,558 a composite structural element is described which has its outer flange surfaces free from a concrete coating, i.e. outside the outline of the profile there is no concrete. The concrete is cast between the flanges into the chamber or channel formed between the flanges and in part by the web of the structural shape, and since the concrete is cast in this chamber, it can be referred to as chamber concrete. The chamber concrete is form-fittingly and force-fittingly engaged with elements projecting into the channel or chamber from the steel structural shape to bond the chamber concrete to the steel both at room temperature and under fire conditions.

The steel profile cross section, the concrete cross section and the effective section of the reinforcing steel embedded in the concrete steel all depend on the load-carrying capabilities and the temperature resistance properties desired.

One of the drawbacks of such structural elements, however, is that the exposed flanges are subject to the thermal action of the fire to a pronounced degree and lose strength. This loss of strength of the flanges, which make up the greater part of the cross section of the steel structural shape, significantly weakens the structural element.

In Luxembourg patent document LU 84 772 corresponding to the commonly assigned copending application Ser. No. 603,509 filed Apr. 24, 1984, and referring to German patent document 28 29 864 (see also U.S. Pat. No. 4,196,558), there is recognized the difficulty of ensuring the requisite temperature distribution in the body of the structural element solely by use of the reinforcing members and there is proposed the embedding in the concrete of at least one further profile or steel structural shape which is connected to the web of the main profile whose outer flange surfaces are not coated with concrete.

Since a portion of this auxiliary or additional profile or structural shape is thermally protected by the surrounding body of concrete, the post, column or girder has especially high load-carrying capacity even under extreme thermal stress as in the case of a fire.

While this structural element has been found to be highly successful in some applications because of its comparatively high cost, large dimensions, complicated construction and mass, it is not useful in many applications although it continues to be a structural element of choice in high-rise construction.

OBJECTS OF THE INVENTION

It is the principal object of the present invention to provide an improved structural element which will have many of the desirable features of the last mentioned composite profile and yet will be free from some of the disadvantages thereof.

Another object of the invention is to provide a fire-resistant composite structural element which will have comparatively small outer dimensions and yet increased load-carrying capacity under high thermal stress and with fire resistance.

Another object of the invention is to provide a fire-resistant composite element so that its load-carrying capacity can be readily adjusted for varying building height requirements, especially the load variations of posts or columns in a building structure.

SUMMARY OF THE INVENTION

These objects and others which will become more readily apparent hereinafter are attained, in accordance with the present invention, by providing a composite structural element consisting of a steel profile having a pair of flanges bridged by a web, a body of concrete received between these flanges so that the outer flange surfaces are not covered with concrete, means for connecting the concrete body to the profile, and at least one iron flat, e.g. a steel plate, connected with the web of the profile.

We have found, quite surprisingly, that the application of an iron flat, i.e. a flat steel plate to the web of the profile and which is secured thereto by welding can greatly increase the load-carrying capacity of the structural element even in the most extreme fire conditions while being simple and space-saving so that the outer dimensions of the structural member need not be increased. The steel plate can be supplied during fabrication of the profile element or at the building site and the load-carrying capacity of the profile can be increased or adjusted to suit requirements depending upon the size of the steel plate applied, the number of steel plates applied and the spacing or lack of spacing of the steel plates along the structural element. In all cases the load-carrying capacity under fire conditions is increased out of proportion to the contribution of the steel plates to the overall steel cross section of the profile and the plates.

According to a feature of the invention, at least one steel plate is applied centrally over the entire length of the profile and on each side of the web and additional plates may be provided above the steel plate adjacent the web on one or both sides.

At least on one side of the web, moreover, two entire flats or steel plates can be disposed so that their longitudinal edges are turned toward one another and in all cases the plates can be spaced apart along the web or extend the full length thereof. The various iron flats can have the same dimensions and can be attached to the web of the profile by welding, e.g. spot welding.

Alternatively, the iron flats or steel plates can be attached to the web by bolts and nuts and in this case and in the cases previously described, the surfaces of the steel plate in contact with the concrete and/or the surfaces of the web and the flat iron can have increased frictional coefficients. The increased frictional coefficient can be obtained by milling or corrugating one or both of the surfaces in contact with one another.

The concrete can be reinforced with steel, reinforcing mats or cages which can be welded to the flat iron or steel plates, the concrete can be connected to the latter by dowels or pins which are embedded in the concrete and/or the concrete can be connected at least in part to the profile by bolts which pass through the web.

When the concrete is not steel reinforced, a colloid concrete or fiber-reinforced concrete can be used which can be connected by dowels or pins to the flat iron or steel plates.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
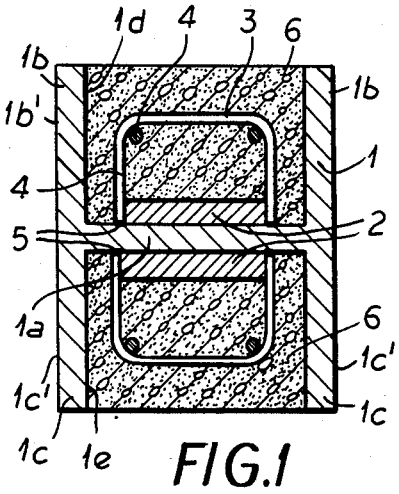
FIG. 1 is a cross section through a composite profile of the present invention in which the steel reinforcement cage or mat is welded to the web of the steel profile and straddles the flat iron member.

From FIG. 1 it will be apparent that an H-beam 1 having a web 1*a* unitary with pairs of flanges 1*b* and 1*c* thereby defines a pair of channels 1*d* and 1*e* which represent the chambers containing the concrete 6. The outer surfaces 1*b*′ and 1*c*′ of the flanges are undercovered by concrete and the concrete does not extend beyond the outline of the profile.

On both sides of the web 1*a*, iron flats or steel plates 2 are welded and the weld junctions can be continuous or formed as spot welds or point welds. Laterally of the plates, reinforcing steel mats 3 having longitudinal reinforcing bars 4 and transverse U-shaped reinforcing bars 4′ are welded to straddle the plates 2.

The steel reinforcement, of course, reduces the possibility of thermal deterioration of the concrete during a fire. The concrete 6 is cast flush with the ends of the flanges around the reinforcing mats 3 and the steel plates 2.

The steel plates 2 can have thicknesses between 10 and 80 mm and it has been found that it is advantageous to make these plates less in width than the webs (by 10 cm or more) to enable welding along the edges of the plates. However, whether a single steel plate is used across the width of the web or a plurality of such steel plates are used across the width of the web, the steel plates should extend over about 70% of the area on each side of the web.

Figure 2:
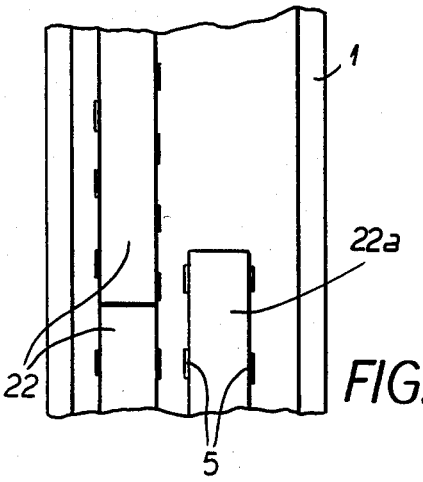
FIG. 2 is an elevational view looking into the channel of a profile according to the invention showing the attachment of steel plates to the web in transversely spaced relationship.

Thus, instead of a single plate disposed centrally of the web as shown in FIG. 1, parallel rows of plates can be provided as shown in FIG. 2 along the web and these need not be symmetrical but can be eccentric if an eccentric load distribution is desired. Furthermore, the plates 22 are seen to extend the full height of the profile while the plates 22*a* extend only part of the height of the post, in case a change in the load distribution because of roof supports or the like may be desired.

Figure 3:
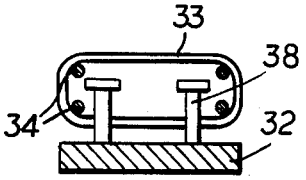
FIG. 3 is a section of a flat iron or plate member provided with the reinforcing mat or cage and the dowels which will serve to anchor the concrete to a steel profile.

FIG. 3 illustrates that the reinforcing steel mats 33 with their longitudinal bars 34 can be held by the concrete on headed dowels 38 so that the mats are suspended from these dowels. The plate 32 of the assembly shown in FIG. 3 is then welded to the web at locations 5 as described and the concrete is cast in place in the chambers 1*c* and 1*d* and vibrated to set the concrete around the dowels and the reinforcement.

Figure 4:
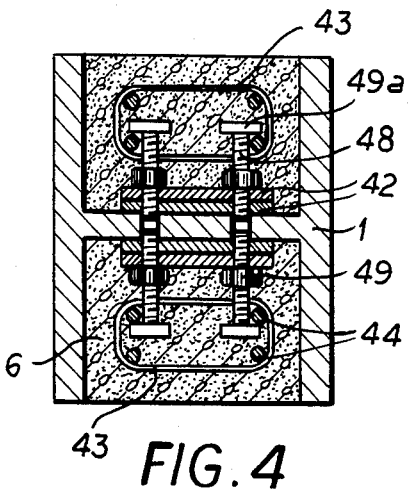
FIG. 4 is a transverse section through another structural element according to the invention.

FIG. 4 illustrates the fact that two or more steel plates 42 can be stacked on each side of the web and that the steel plates can be held in place at least in part by bolts 48 and nuts 49 and 49*a*, the bolt and nut arrangement being threaded into the web. The steel reinforcing mats or cages 43 can be attached to the bolts in the manner described in FIG. 3 and the nuts 49 can be tightened to clamp the plates 42 against the web. The nuts 49*a* of the bolts can also be fitted in place before application of the reinforcements. The use of more than one plate allows adjustment of the load-carrying capacity to the various height requirements of the column. It has been found to be advantageous to facilitate mounting to provide the holes required in the profile and in the plates 42 at the fabrication plant for the profile.

When the assembly of reinforcements, iron plates and profile has been formed, this assembly can be laid on the ground and one chamber filled with concrete after tightening of the bolts, preferably with setting of the concrete by vibration, after curing the assembly can be turned over and filled on the other side with concrete following these steps a second time.

Figure 5:
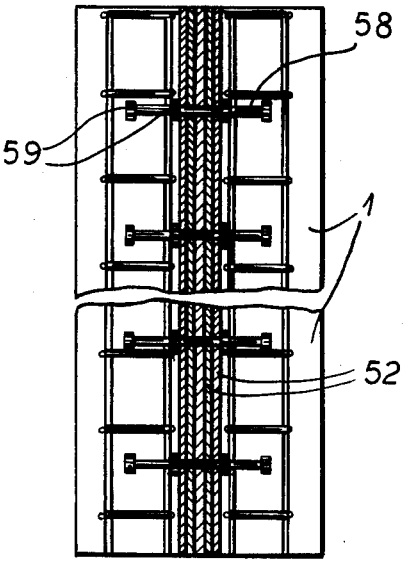
FIG. 5 is a longitudinal section through a structural element illustrating another embodiment of the invention.
Figure 6:
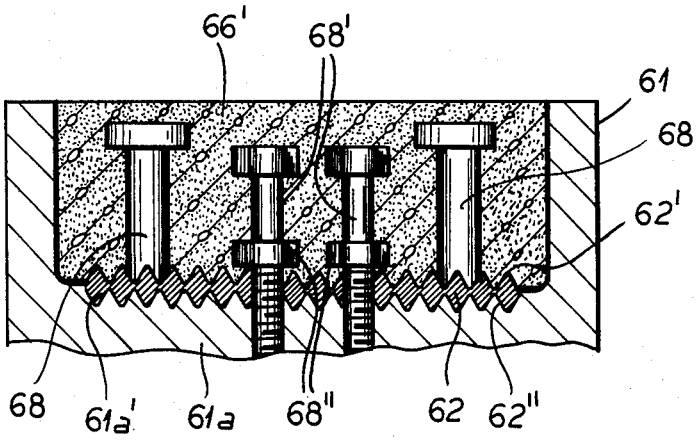
FIG. 6 is a fragmentary cross section showing still another embodiment according to the invention.

FIG. 5 represents a longitudinal section through a steel profile whose web is flanked by iron plates 52 connected by bolts and nuts 58 and 59. The bolts can be ordinary bolts or tight-fitting and high-strength bolts. To increase the friction coefficients at the surfaces of the plate and the parts engaging same, steel casting, shot blasting, sand blasting or flame treatment can be used, or a high-resistance coating or corrugation or milling can be employed. This can be seen from FIG. 6 where the plate 62 is provided with grooved or corrugated surfaces 62′ and 62″ in contact with the concrete 66 and in contact with a correspondingly grooved surface 61*a*′ in the web 61*a* of the profile 61. The headed dowels 68 previously welded onto the plate 62 project into the concrete as do the heads of bolts 68' which traverse the web 61*a*. The plates are held by tightening of nuts (not shown) on the opposite side of the profile. The concrete is filled with steel fiber as shown at 66'.

While in the embodiments illustrated the flanges are unitary with the web, the structural shape which can be used need not be such a rolled steel shape but one which can be built up by welding or bolting from separate flange and web elements.

We claim:

1. A fire-resistant composite structural element, comprising:

a one-piece steel structural shape comprising at least one pair of flanges bridged by a web having a web surface and defining between said flanges a channel;

a flat steel plate having a plate surface affixed to the web surface and extending over at least part of the length of said structural shape within said channel, the plate being completely out of contact with the flanges and having opposite edges spaced inward from the respective flanges;

steel reinforcement secured substantially only to the plate; and a body of concrete at least partially filling said channel, imbedding the reinforcement, and affixed to said structural shape while enclosing said plate and filling between the plate edges and said flanges, outer surfaces of said flanges being free from concrete covering.

2. The fire-resistant composite structural element defined in claim 1 wherein said web is flanked on each side thereof by at least one centrally disposed steel plate extending the length of said structural shape.

3. The fire-resistant composite structural element defined in claim 1 wherein said web is provided with two steel plates in said channel having longitudinal edges turned toward one another and parallel to one another.

4. The fire-resistant composite structural element defined in claim 1 wherein a plurality of steel plates are applied to said web, said steel plates having identical dimensions.

5. The fire-resistant composite structural element defined in claim 1 wherein said steel plate is secured to said web by welding.

6. The fire-resistant composite structural element defined in claim 1 wherein said steel plate is secured to said plate by bolts at least partly traversing said web and extending through said steel plate.

7. The fire-resistant composite structural element defined in claim 1 wherein at least one of said surfaces is provided with friction-increasing facing.

8. The fire-resistant composite structural element defined in claim 7 wherein said facing is a surface roughening.

9. The fire-resistant composite structural element defined in claim 7 wherein said facing is a grooving of the surface.

10. The fire-resistant composite structural element defined in claim 1 wherein said reinforcement is welded to said plate.

11. The fire-resistant composite structural element defined in claim 1 wherein said reinforcement is welded to dowel pins extending into said concrete and secured to said plate.

12. The fire-resistant composite structural element defined in claim 1 wherein bolts traversing said plate are secured to said reinforcement.

13. The fire-resistant composite structural element defined in claim 1 wherein said plate is provided with members projecting into said concrete and said concrete is cast around said members.

14. The fire-resistant composite structural element defined in claim 13 wherein said members are headed dowels welded to said plate.

15. The fire-resistant composite structural element defined in claim 13 wherein said members are bolts traversing said plate.

16. The fire-resistant composite structural element defined in claim 13 wherein said concrete is a fiber-reinforced or colloid concrete.

17. The fire-resistant composite structural element defined in claim 14 wherein said concrete is a fiber-reinforced or colloid concrete.

18. The fire-resistant composite structural element defined in claim 15 wherein said concrete is a fiber-reinforced or colloid concrete.

19. The fire-resistant composite structural element defined in claim 7 wherein said steel plate is provided on both of its surfaces with friction-increasing facing.

* * * * *